US009217570B2

(12) United States Patent
Parsania et al.

(10) Patent No.: US 9,217,570 B2
(45) Date of Patent: Dec. 22, 2015

(54) AXIAL FLOW FUEL NOZZLE WITH A STEPPED CENTER BODY

(75) Inventors: Nishant Govindbhai Parsania, Karnataka (IN); Geoffrey D. Myers, Greenville, SC (US); Gregory Allen Boardman, Greer, SC (US)

(73) Assignee: General Electric Company, Schenectady, NY (US)

( * ) Notice: Subject to any disclaimer, the term of this patent is extended or adjusted under 35 U.S.C. 154(b) by 696 days.

(21) Appl. No.: 13/354,897

(22) Filed: Jan. 20, 2012

(65) Prior Publication Data

US 2013/0186094 A1 Jul. 25, 2013

(51) Int. Cl.

| | |
|---|---|
| ***F02C 3/30*** | (2006.01) |
| ***F23R 3/14*** | (2006.01) |
| ***F23R 3/28*** | (2006.01) |
| ***F23L 7/00*** | (2006.01) |
| ***F23D 11/16*** | (2006.01) |

(52) U.S. Cl.

CPC ..... *F23R 3/286* (2013.01); *F23D 11/16* (2013.01); *F23L 7/002* (2013.01); *F23R 3/14* (2013.01)

(58) Field of Classification Search

CPC ..... F02C 3/30; F23C 2900/07001; F23D 17/002; F23D 2900/00008; F23L 7/002; F23L 7/00; F23L 7/00008; F23R 3/286; F23R 3/14

USPC ..... 60/734, 737, 738, 740, 742, 748, 775, 60/39.26, 39.3, 39.53

See application file for complete search history.

(56) References Cited

U.S. PATENT DOCUMENTS

| | | | | |
|---|---|---|---|---|
| 4,373,325 | A * | 2/1983 | Shekleton | 60/776 |
| 4,850,194 | A * | 7/1989 | Fuglistaller et al. | 60/737 |
| 5,062,792 | A | 11/1991 | Maghon | |
| 5,193,995 | A | 3/1993 | Keller et al. | |
| 5,351,477 | A | 10/1994 | Joshi et al. | |
| 5,408,830 | A * | 4/1995 | Lovett | 60/737 |
| 5,816,049 | A * | 10/1998 | Joshi | 60/737 |
| 6,363,724 | B1 * | 4/2002 | Bechtel et al. | 60/737 |
| 6,434,945 | B1 * | 8/2002 | Mandai et al. | 60/740 |
| 6,453,660 | B1 * | 9/2002 | Johnson et al. | 60/39.821 |
| 6,460,326 | B2 * | 10/2002 | Bechtel et al. | 60/39.465 |
| 7,143,583 | B2 * | 12/2006 | Hayashi et al. | 60/776 |
| 7,434,401 | B2 * | 10/2008 | Hayashi | 60/743 |
| 7,533,532 | B1 * | 5/2009 | Toon et al. | 60/740 |
| 2005/0039456 | A1 * | 2/2005 | Hayashi | 60/737 |
| 2010/0089367 | A1 | 4/2010 | Johnson et al. | |
| 2010/0199674 | A1 | 8/2010 | Widener et al. | |

* cited by examiner

*Primary Examiner* — Steven Sutherland

(74) *Attorney, Agent, or Firm* — Nixon & Vanderhye P.C.

(57) ABSTRACT

An axial flow fuel nozzle for a gas turbine includes a plurality of annular passages for delivering materials for combustion. An annular air passage receives compressor discharge air, and a plurality of swirler vane slots are positioned adjacent an axial end of the annular air passage. A first next annular passage is disposed radially inward of the annular air passage and includes first openings positioned adjacent an axial end of the first annular passage and downstream of the swirler vane slots. A second next annular passage is disposed radially inward of the first annular passage and includes second openings positioned adjacent an axial end of the second annular passage and downstream of the first openings.

9 Claims, 2 Drawing Sheets

AXIAL FLOW FUEL NOZZLE WITH A STEPPED CENTER BODY

BACKGROUND OF THE INVENTION

The invention relates to fuel nozzles and, more particularly, to an axial flow fuel nozzle for a gas turbine including a plurality of annular passages to facilitate mixing.

Gas turbine engines generally include a compressor for compressing an incoming airflow. The airflow is mixed with fuel and ignited in a combustor for generating hot combustion gases. The combustion gases in turn flow to a turbine. The turbine extracts energy from the gases for driving a shaft. The shaft powers the compressor and generally another element such as an electrical generator. The exhaust emissions from the combustion gases generally are a concern and may be subject to mandated limits. Certain types of gas turbine engines are designed for low exhaust emissions operation, and in particular, for low NOx (nitrogen oxides) operation with minimal combustion dynamics, ample auto-ignition, and flame holding margins.

In existing low NOx combustor nozzles, a liquid fuel circuit directly injects fuel and water in a recirculation zone (combustion zone). Rich burning of fuel produces high temperatures, which cause the formation of higher emissions. Existing designs also use atomizing air and water together for NOx reduction. It would be desirable to provide a simple design with better liquid fuel atomization in a premixing passage to reduce emissions while also making better use of curtain air.

BRIEF DESCRIPTION OF THE INVENTION

In an exemplary embodiment, an axial flow fuel nozzle for a gas turbine includes a plurality of annular passages for delivering materials for combustion. An annular air passage receives compressor discharge air, and a plurality of swirler vane slots are positioned adjacent an axial end of the annular air passage. A first annular passage is disposed radially inward of the annular air passage and includes first openings positioned adjacent an axial end of the first annular passage and downstream of the swirler vane slots. A second annular passage is disposed radially inward of the first annular passage and includes second openings positioned adjacent an axial end of the second annular passage and downstream of the first openings.

In another exemplary embodiment, an annular air passage receives compressor discharge air, and a plurality of swirler vane slots are positioned adjacent an axial end of the annular air passage. The annular air passage delivers curtain/atomizing air to a premix area downstream of the swirler vane slots via the swirler vane slots. An annular liquid fuel passage is disposed radially inward of the annular air passage and delivers liquid fuel to the premix area. An annular water passage is disposed radially inward of the annular liquid fuel passage and delivers water to the premix area, where the water serves to cool the fuel nozzle and facilitates mixing of the liquid fuel and compressor discharge air.

In yet another exemplary embodiment, a method of premixing fuel and air for combustion in a gas turbine includes the steps of flowing compressor discharge air through an annular air passage and through a plurality of swirler vane slots positioned adjacent an axial end of the annular air passage to a premix area downstream of the swirler vane slots; delivering one of (1) fuel, (2) water, and (3) a mix of fuel and water via a first annular passage disposed radially inward of the annular air passage to the premix area; and delivering one of (1) water and (2) air via a second annular passage disposed radially inward of the first annular passage to the premix area.

DETAILED DESCRIPTION OF THE INVENTION

Figure 1:
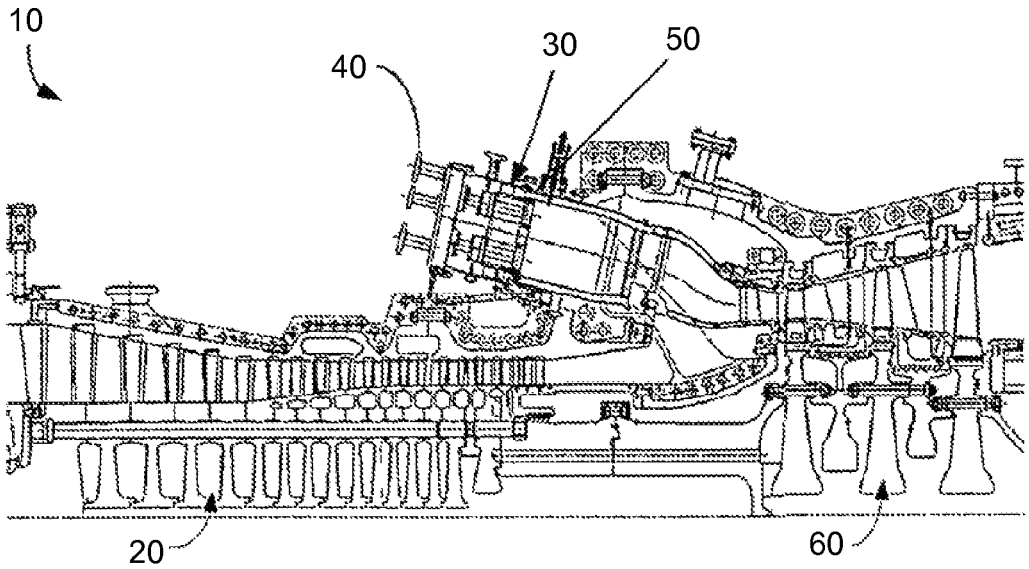
FIG. 1 is a side cross-sectional view of a gas turbine engine.

FIG. 1 shows a cross-sectional view of a gas turbine engine 10. The gas turbine engine 10 includes a compressor 20 to compress an incoming airflow. The compressed airflow is then delivered to a combustor 30 where it is mixed with fuel from a number of incoming fuel lines 40. The combustor 30 may include a number of combustor cans or nozzles 50 disposed in a casing 55. As is known, the fuel and the air may be mixed within the nozzles 50 and ignited. The hot combustion gases in turn are delivered to a turbine 60 so as to drive the compressor 20 and an external load such as a generator and the like. The nozzles 50 typically include one or more swirlers.

Figure 2:
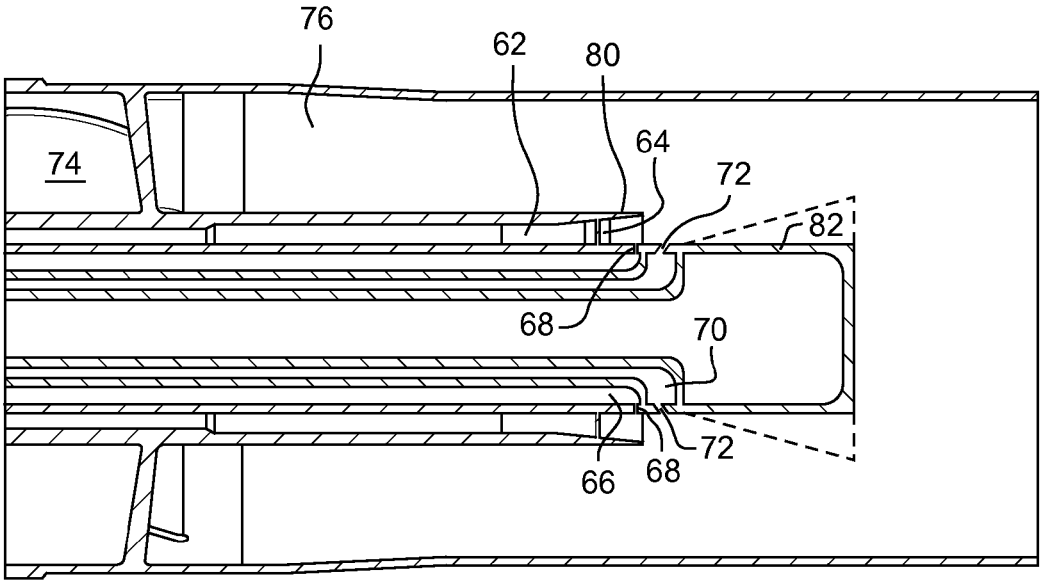
FIG. 2 is a sectional view of a fuel nozzle according to the described embodiments.

FIG. 2 is a cross section through an axial flow fuel nozzle according to the described embodiments. The fuel nozzle includes a plurality of annular passages. An annular air passage 62 defines a radially outermost passage and receives compressor discharge air. A plurality of swirler vane slots 64 are positioned adjacent an axial end of the annular air passage 62 as shown. A first next annular passage 66 is disposed radially inward of the annular air passage 62. The first next annular air passage 66 includes first openings 68 positioned adjacent an axial end of the passage 66. The openings 68 are positioned downstream of the swirler vane slots 64. A second next annular passage 70 is disposed radially inward of the first annular passage and includes second openings 72 positioned adjacent an axial end of the passage 70 and downstream of the first openings 68.

In one embodiment, the first annular passage 66 is coupled with a source of liquid fuel. In this context, the first openings 68 are positioned relative to the annular air passage 62 such that air passing through the swirler vane slots 64 at least partially atomizes the liquid fuel flowing through the first openings 68. In this arrangement, the second annular passage 70 may be coupled with a source of water. In this context, the second openings 72 are positioned relative to the first openings 68 such that water passing through the second openings 72 impacts the liquid fuel flowing through the first openings 68. The area upstream of the swirler vane slots 64 adjacent the first and second openings 68, 72 serves as a premix area.

In an alternative operation, the second annular passage 70 may be coupled with a source of air. In this context, the second openings 72 are positioned relative to the first openings 68 such that air passing through the second openings 72 impacts the liquid fuel flowing through the first openings 68. The second openings 72 may be oriented such that air passing through the second openings 72 creates an annular air layer along a distal end of the nozzle center body. The annular air layer or air curtain serves to cool the center body and also atomizes the liquid fuel jet.

The first annular passage 66 may still alternatively be coupled with a source of mixed liquid fuel and water. The use of water serves to make the system cooler, thereby reducing carbon deposits. Additionally, water serves to cool flame temperatures and reduce NOx emissions. Air in the second annular passage 68 serves to clean the surface downstream of fuel input, which can reduce concerns with regard to flame holding.

During a gas operation, all three passages may be coupled with sources of air only.

The vane slots 64 produce shear and increase gas mixing. A greater angle (e.g., greater than 45°) strengthens the center recirculation by increasing swirl, which is desirable for flame stability. The fuel holes 68 are preferably placed such that high velocity air in the air passage 62 serves to break the fuel jet. The momentum ratio can be easily controlled by controlling the number of holes 68 and slots 64. The addition of water also serves to break the fuel jet and reduces NOx while also cooling the liquid fuel and preventing clogging (anti-cocking).

Figure 3:
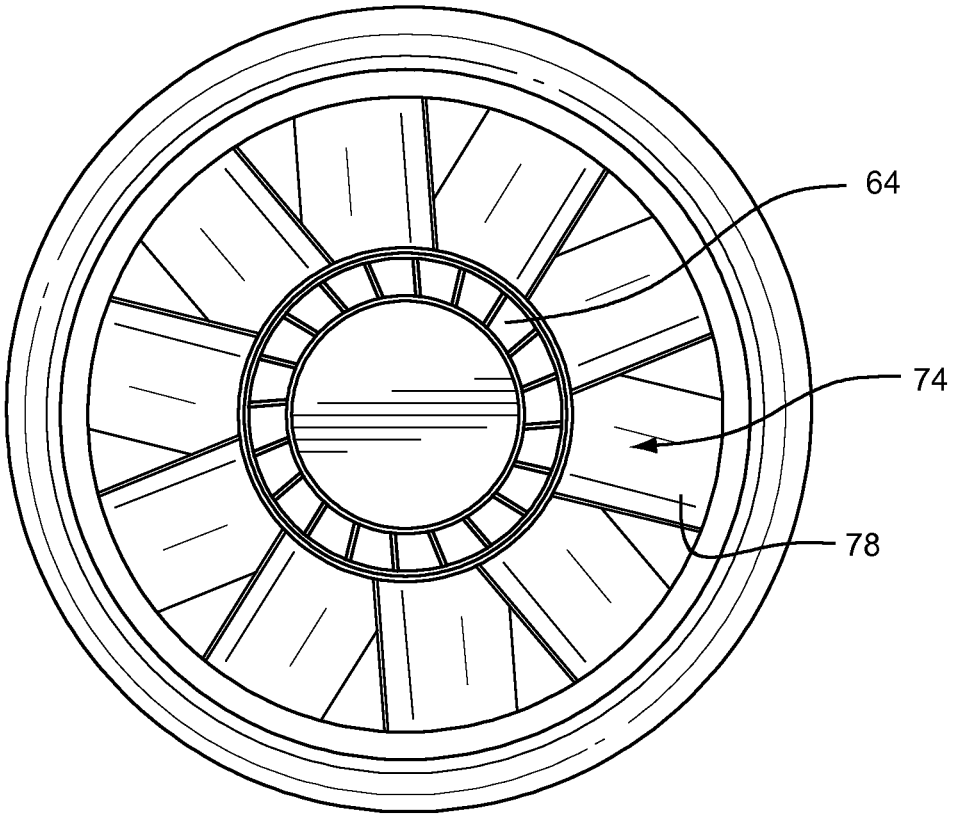
FIG. 3 is an end view of the fuel nozzle.

With reference to FIGS. 2 and 3, main combustion air flows through a main combustion air swirler 74 disposed at an upstream end of a main combustion air passage 76. As shown, the main combustion air passage 76 is disposed surrounding the annular air passage 62. The main combustion air swirler includes vanes 78 that are oriented to impart swirl to air flowing through the main combustion air swirler 74. The swirler vane slots 64 in the annular air passage 62 may be oriented with the same orientation as the vanes 78 of the main combustion air swirler 74 or with the opposite orientation. With the swirler vane slots 64 aligned with the main swirler vanes 78, a lower pressure drop is effected through the nozzle; and with the slots arranged in the opposite orientation, better mixing may be achieved.

With continued reference to FIG. 2, the distal end 80 of the annular air passage 62 may be tapered from a first thickness to a second thinner thickness as shown. For example, the thickness at the distal end may be as small as 0.012-0.020 inches (12-20 mils) or smaller. The end 80 is shown downstream of the swirler vane slots and generally in radial alignment with the first openings 68. In the embodiment where the first annular passage 66 delivers liquid fuel via the openings 68, the end 80 prevents the liquid fuel from making contact with the burner tube casing. This is desirable to prevent flame holding and damage to the burner casing. The lip serves to create a film of liquid fuel or liquid fuel jet for better atomization of the fuel.

The air passage 62 is traditionally used for cooling the nozzle center body 82. As shown in dashed line, the nozzle center body may also be tapered, wherein a larger center body diameter can be better for flame stabilization. The passage 62 drives compressor discharge air through the swirler vane slots 64. With the structure of the described embodiments, this air is diverted such that it is used to first atomize the liquid fuel jet and then cool the center body and center body tip by forming a layer of only air at the center body and tip. During gas operation, this air can be used for further mixing as it creates a shear layer above the hub with the main swirler air. It is possible to have a fuel hole pattern that generates a slightly hub-midspan rich gas fuel air mixing profile. That is, with curtain air mixing with the main air, it is possible to adjust the fuel-air mixing profile.

The next radially inward passage 66 may be for liquid fuel, or, as noted, during the gas operation it may be purged with air. The circuit may contain only liquid fuel or emulsion fuel (liquid fuel mixed with water).

The next radially inward passage 70 is preferably for water, which water cools the liquid fuel from beneath to avoid carbon formation/cocking problems. As shown, the holes 72 are placed such that water flowing through the holes hits the fuel jet and removes any low velocity region (to avoid flame holding just behind the jet) with water behind the fuel jet. The water helps to break the fuel jet. At a downstream location, water mixing with fuel and while burning serves to reduce local temperatures and reduce NOx formation.

Liquid fuel orifices 68 and water orifices 72 may be placed near each other such that water may have better chance to impact/mix with the liquid fuel. As noted, in an alternative embodiment, atomizing air may be included with low-pressure ratio instead of water. Cold atomizing air may cool the liquid fuel passage from beneath and will help atomization of the liquid fuel jet.

Generally, the design provides an inexpensive way to incorporate liquid fuel with better atomizing and premixing (resulting in lower emissions). The design also enhances gas fuel operations and cooling of the center body tip. The improved atomization and premixing serves to decrease concentrated burning and resulting high temperatures, thereby reducing NOx emissions. By providing the curtain air for gas side premixing, with a shear layer, it is possible to have rapid mixing near the center body tip. The design may also reduce the requirement of water and may eliminate use of atomizing air thereby improving the heat rate on liquid fuel operation.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. An axial flow fuel nozzle for a gas turbine, the axial flow fuel nozzle comprising:

an annular air passage configured to receive compressor discharge air;

a plurality of swirler vane slots positioned adjacent a downstream axial end of the annular air passage, closer to the downstream axial end than an upstream axial end;

a first annular passage disposed radially inward of the annular air passage and including first openings positioned adjacent an axial end of the first annular passage and downstream of the plurality of swirler vane slots;

a second annular passage disposed radially inward of the first annular passage and including second openings positioned adjacent an axial end of the second annular passage and downstream of the first openings; and a nozzle center body cooperable with the first and second annular passages, the nozzle center body terminating downstream of the first openings and the second openings, wherein the first annular passage is coupled with one of a source of liquid fuel and a source of mixed liquid fuel and water, and wherein the second annular passage is coupled with a source of water.

2. An axial flow fuel nozzle according to claim 1, wherein the first annular passage is coupled with a source of liquid fuel.

3. An axial flow fuel nozzle according to claim 2, wherein the first openings are positioned relative to the annular air passage such that air passing through the swirler vane slots is configured to at least partially atomize liquid fuel flowing through the first openings.

4. An axial flow fuel nozzle according to claim 1, wherein the second openings are positioned relative to the first openings such that water passing through the second openings is configured to impact liquid fuel flowing through the first openings.

5. An axial flow fuel nozzle according to claim 1, wherein a distal end of the annular air passage is tapered from a first thickness to a second thinner thickness.

6. An axial flow fuel nozzle for a gas turbine, the axial flow fuel nozzle comprising:

an annular air passage configured to receive compressor discharge air;

a plurality of swirler vane slots positioned adjacent a downstream axial end of the annular air passage, closer to the downstream axial end than an upstream axial end;

a first annular passage disposed radially inward of the annular air passage and including first openings positioned adjacent an axial end of the first annular passage and downstream of the plurality of swirler vane slots;

a second annular passage disposed radially inward of the first annular passage and including second openings positioned adjacent an axial end of the second annular passage and downstream of the first openings; and a nozzle center body cooperable with the first and second annular passages, the nozzle center body terminating downstream of the first openings and the second openings, wherein the first annular passage is coupled with one of a source of liquid fuel and a source of mixed liquid fuel and water, the axial flow fuel nozzle further comprising a main combustion air swirler disposed at an upstream end of a main combustion air passage, the main combustion air passage disposed surrounding the annular air passage, wherein the main combustion air swirler includes vanes that are oriented to impart swirl to air flowing through the main combustion air swirler, and wherein the plurality of swirler vane slots are oriented with the same orientation as the vanes of the main combustion air swirler.

7. An axial flow fuel nozzle for a gas turbine, the axial flow fuel nozzle comprising:

an annular air passage configured to receive compressor discharge air;

a plurality of swirler vane slots positioned adjacent a downstream axial end of the annular air passage, closer to the downstream axial end than an upstream axial end;

a first annular passage disposed radially inward of the annular air passage and including first openings positioned adjacent an axial end of the first annular passage and downstream of the plurality of swirler vane slots;

a second annular passage disposed radially inward of the first annular passage and including second openings positioned adjacent an axial end of the second annular passage and downstream of the first openings; and a nozzle center body cooperable with the first and second annular passages, the nozzle center body terminating downstream of the first openings and the second openings, wherein the first annular passage is coupled with one of a source of liquid fuel and a source of mixed liquid fuel and water, the axial flow fuel nozzle further comprising a main combustion air swirler disposed at an upstream end of a main combustion air passage, the main combustion air passage disposed surrounding the annular air passage, wherein the main combustion air swirler includes vanes that are oriented to impart swirl to air flowing through the main combustion air swirler, and wherein the plurality of swirler vane slots are oriented with the opposite orientation as the vanes of the main combustion air swirler.

8. An axial flow fuel nozzle for a gas turbine, the axial flow fuel nozzle comprising:

an annular air passage configured to receive compressor discharge air;

a plurality of swirler vane slots positioned adjacent a downstream axial end of the annular air passage closer to the downstream axial end than an upstream axial end, wherein the annular air passage is configured to deliver curtain/atomizing air to a premix area downstream of the plurality of swirler vane slots via the plurality of swirler vane slots;

an annular liquid fuel passage disposed radially inward of the annular air passage, the annular liquid fuel passage is configured to deliver liquid fuel to the premix area; and an annular water passage disposed radially inward of the annular liquid fuel passage, the annular water passage is configured to deliver water to the premix area, wherein the water serves to cool the fuel nozzle and facilitates mixing of the liquid fuel and the compressor discharge air.

9. An axial flow fuel nozzle according to claim 8, wherein the annular liquid fuel passage includes first openings positioned adjacent an axial end of the annular liquid fuel passage and downstream of the swirler vane slots, and wherein the annular water passage includes second openings positioned adjacent an axial end of the annular water passage and downstream of the first openings.

* * * * *

UNITED STATES PATENT AND TRADEMARK OFFICE

CERTIFICATE OF CORRECTION

PATENT NO. : 9,217,570 B2
APPLICATION NO. : 13/354897
DATED : December 22, 2015
INVENTOR(S) : Parsania et al.

It is certified that error appears in the above-identified patent and that said Letters Patent is hereby corrected as shown below:

In the Specification

At column 3, line 35, insert --64-- after "the swirler vane slots".

Signed and Sealed this
Twenty-second Day of March, 2016

Michelle K. Lee

Michelle K. Lee
*Director of the United States Patent and Trademark Office*